United States Patent [19]

Pannone et al.

[11] 3,935,614

[45] Feb. 3, 1976

[54] ELECTROMECHANICAL DOOR HOLDER-CLOSER

[75] Inventors: Robert John Pannone, Bristol; Walter Edward Surko, Jr., Southington, both of Conn.

[73] Assignee: Emhart Corporation, Farmington, Conn.

[22] Filed: Aug. 23, 1974

[21] Appl. No.: 499,908

Related U.S. Application Data

[63] Continuation-in-part of Ser. No. 293,079, Sept. 28, 1972, abandoned.

[52] U.S. Cl. ..... 16/48.5; 16/49; 188/82.84; 192/45

[51] Int. Cl.[2] ..... E05F 15/20

[58] Field of Search ..... 16/48.5, 49, 82, 57, 58, 16/139, 140, 141; 292/263; 49/139, 141, 326, 374; 193/3; 192/45; 188/82.84

[56] References Cited

UNITED STATES PATENTS

| | | | |
|---|---|---|---|
| 1,184,567 | 5/1916 | Poorman et al. | 16/140 |
| 1,214,403 | 1/1917 | Wright | 188/82.84 |
| 1,243,181 | 10/1917 | Keiper | 188/82.84 |
| 1,644,249 | 10/1927 | Harrison | 16/82 X |
| 1,739,947 | 12/1929 | Chilton | 192/45 X |
| 2,079,528 | 5/1937 | Richardson | 192/45 |
| 2,306,259 | 12/1942 | Khoenle | 192/45 X |
| 2,598,958 | 6/1952 | Wood | 16/48.5 X |
| 2,639,459 | 5/1953 | Werner | 188/82.84 X |
| 3,729,771 | 5/1973 | Crane | 16/48.5 |

FOREIGN PATENTS OR APPLICATIONS

| | | | |
|---|---|---|---|
| 156,657 | 3/1904 | Germany | 16/49 |

*Primary Examiner*—Roy D. Frazier
*Assistant Examiner*—Peter A. Aschenbrenner
*Attorney, Agent, or Firm*—McCormick, Paulding & Huber

[57] ABSTRACT

An electromechanical door holder-closer includes a conventional door closer which has a shaft rotatable in response to movement of a door between its open and closed positions and resilient means for yieldably resisting rotation of the shaft in one direction. A latching mechanism cooperates in a latching position with a uni-directional clutch mounted on the shaft to permit free movement of the door from its closed position toward its open position and to releasably retain the door in a selected hold-open position therebetween when the latching mechanism is held in cooperative engagement with the clutch. The latching mechanism is releasably retained in its latching position by a normally energized electrically operated holding mechanism. Means may be provided for adjusting the device from one hold-open position to another hold-open position of lesser opening by manually moving the door toward its closed position and to its new hold-open position while the latching mechanism is held in latched position by the holding mechanism. Means is also provided for overriding the latching and holding mechanism to release the door from its hold-open position in response to manual force applied thereto in the closing direction.

50 Claims, 12 Drawing Figures

5
5

ELECTROMECHANICAL DOOR HOLDER-CLOSER

CROSS-REFERENCE TO RELATED APPLICATION

This is a continuation-in-part of application Ser. No. 293,079, now abandoned, filed Sept. 28, 1972.

BACKGROUND OF THE INVENTION

This invention relates in general to door operating devices and deals more particularly with improved door closing devices of the type which include hold-open mechanisms for automatic remote release in the event of emergency. Devices of the aforedescribed general type are extensively employed in schools, hospitals, public buildings and industrial establishments, wherein it is desirable that certain doors be maintained in at least partially open position during normal hours of operation, but close automatically upon occurrence of an emergency, as for example, a smoke or fire condition.

It is the general aim of the present invention to provide improved electromechanical devices of the aforedescribed general type which may be readily adjusted to desired hold-open position, and which may, if desired, include additional adjustment features to permit adjustment from one hold-open position to a lesser hold-open position by door movement. The devices of the present invention fail safe to assure door closure in the event of power interruption, for any reason, and permit an associated door to be manually closed from a hold-open position.

SUMMARY OF THE INVENTION

In accordance with the present invention, an apparatus for operating a door mounted for pivotal movement between open and closed positions includes a shaft which rotates when the door moves between its positions. The device further includes a clutch and means for coupling the clutch to the shaft for rotation therewith. A latching mechanism cooperable with the clutch in a latching position releasably retains the clutch to permit rotation of the shaft in only one direction in response to movement of the door toward one of its positions and to prevent rotation of the shaft in its opposite direction in response to a predetermined torque applied to the shaft. An electrically operated means is provided for releasably holding the latching means in its latching position.

DETAILED DESCRIPTION OF THE PREFERRED EMBODIMENTS

Figures 1, 2, 4:
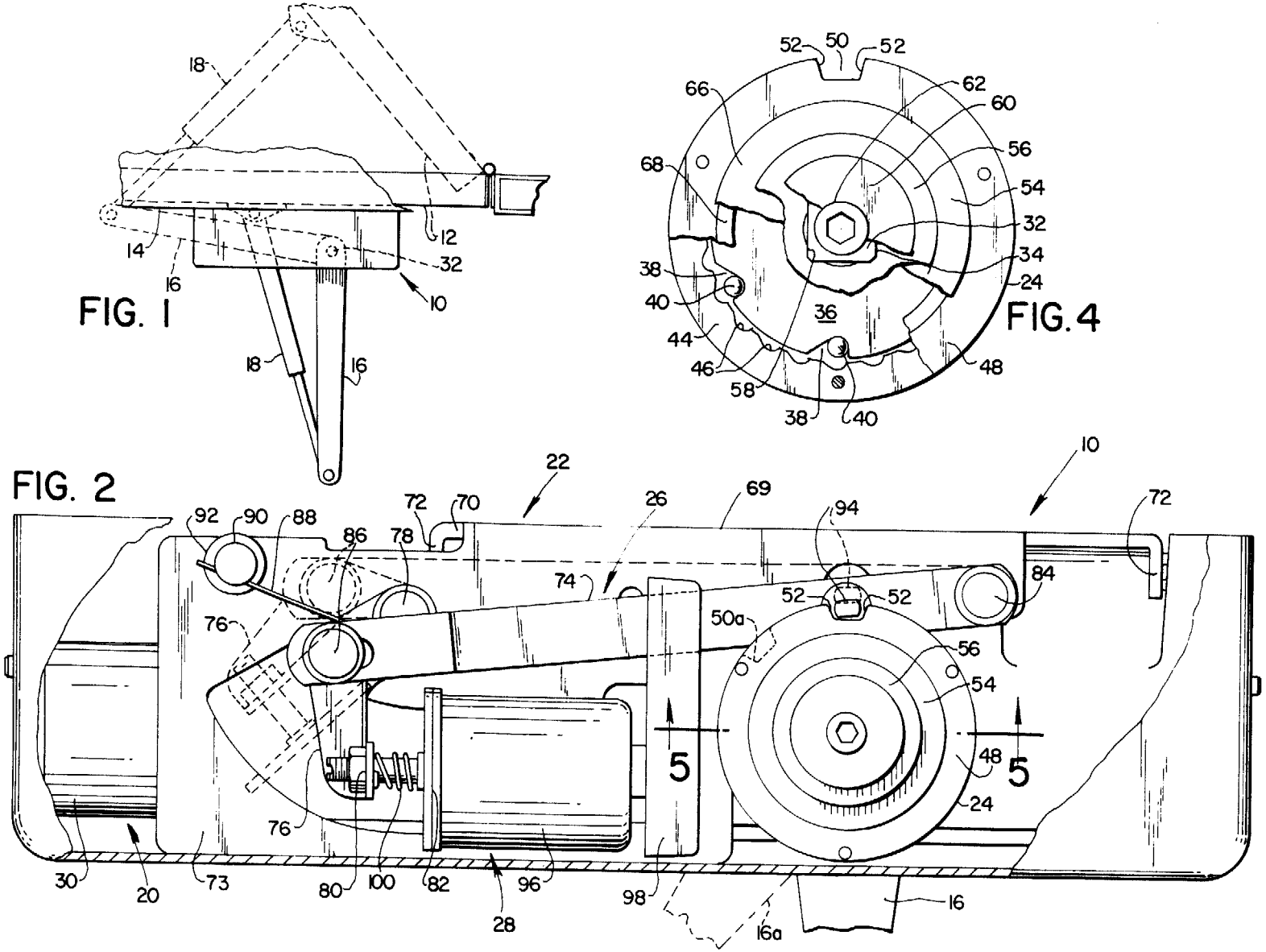
FIG. 1 is a plan view of a device embodying the present invention, shown connected between a door and door frame, and shown in solid lines with the door closed and in broken lines with the door held in a partially open position by the device.
FIG. 2 is a plan view of the device of FIG. 1, shown with a portion of its cover broken away to reveal the structure therein.
FIG. 4 is a somewhat enlarged plan view of the clutch mechanism of the apparatus of FIG. 1, parts thereof shown broken away.
Figure 3:
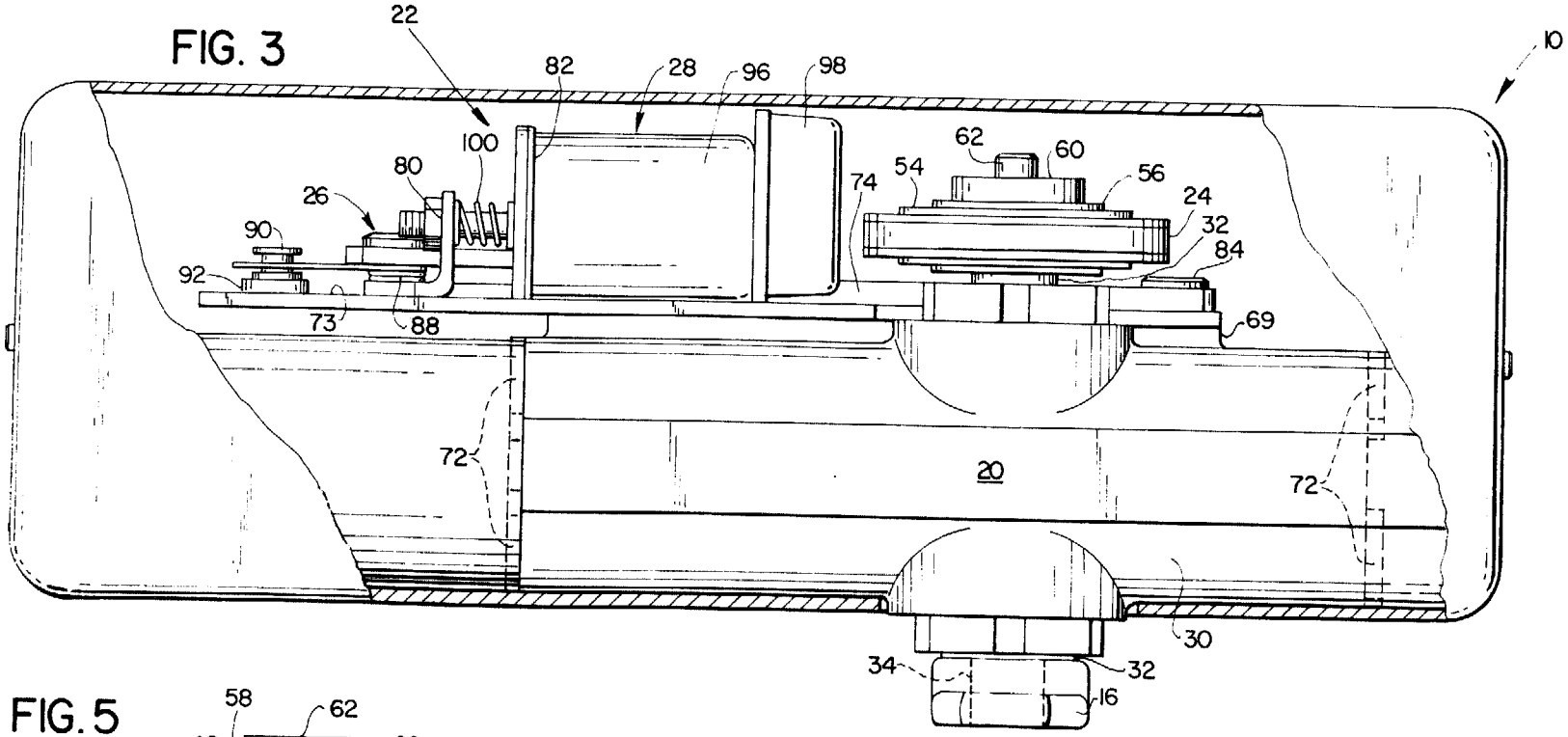
FIG. 3 is a side elevational view of the device of FIG. 1 also shown with a portion of the cover broken away.

Turning now to the drawings, and referring first particularly to FIGS. 1–3, a device embodying the present invention and indicated generally by the reference numeral 10 is shown in FIG. 1 connected between a door 12 and its associated frame 14. As illustrated, the device is mounted on the top jamb of the door frame 14 and connected to the door 12 by a pair of arms 16 and 18 which comprise part of the illustrated device. However, other mounting and connecting arrangements may be employed, as will be evident from the following further description of the device.

The device 10 generally comprises a conventional door closer indicated generally at 20, which performs well known door closing and checking functions, and an attachment indicated generally at 22 cooperable with the door closer 20 to provide door hold-open and release functions hereinafter described. The attachment 22 includes a unidirectional or one-way engaging clutch 24 for mounting on the closer 20 and a mounting bracket or frame 69 which supports the closer 20, a latching mechanism comprising a liner system indicated generally by the numeral 26 cooperable with the clutch in a latching position, and an electrically operated holding and releasing mechanism designated generally at 28 for releasably retaining the lever system in its latched position.

Figure 6:
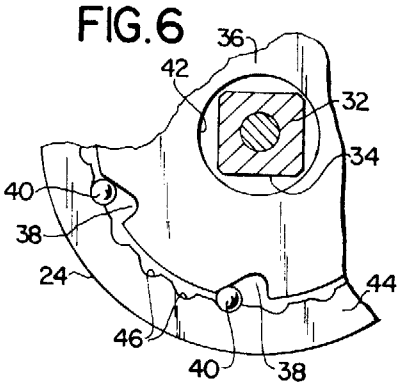
FIG. 6 is a somewhat reduced fragmentary sectional view taken along the line 6—6 of FIG. 5.

Conventional door closers of various types may be used in practicing the invention, and, if desired, a closer may be manufactured as an integral part of the device, but preferably, and as shown, a Series 100 Door Closer, manufactured by P & F Corbin Division, Emhart Corporation, is employed. The door closer 20 has a casing 30 and a shaft or spindle 32 which is journalled therein and extends therethrough. The spindle has upper and lower end portions 34, 34 which respectively project above and below the casing. Each end portion has a substantially square cross-section as best shown in FIG. 6 for selective non-rotatable connection with the arm 16. The closer 20 is not handed, that is, it may be mounted to operate a door of either hand without modification and it is for this reason that two spindle end portions 34, 34 are provided for selective use. In the illustrated case, the arm 16 is non-rotatably connected to the spindle lower end portion 34 and causes the spindle to rotate when the door moves between its open and closed positions. A closer spring (not shown) contained in the left end of the casing 30, as it appears in FIG. 3, acts upon a horizontally disposed rack which drivingly engages a pinion (not shown) mounted on the spindle 32. The closer spring yieldably resists rotation of the spindle 32 in one direction or in a clockwise direction as viewed from above and as shown in FIG. 2.

Hence, rotation of the arm 16 in a clockwise direction, as by opening the door 12, compresses or loads the closer compression spring to store energy therein for closing the door. A piston (not shown) associated with the aforementioned rack acts upon a quantity of hydraulic fluid or the like entrapped within the casing 30 to check or dampen movement of the door. The aforesaid closer may also be provided with means for adjusting the power of the closer spring and other means for adjusting the closing and latching speed of an associated door, all of which is well known to those skilled in the art.

Figure 5:
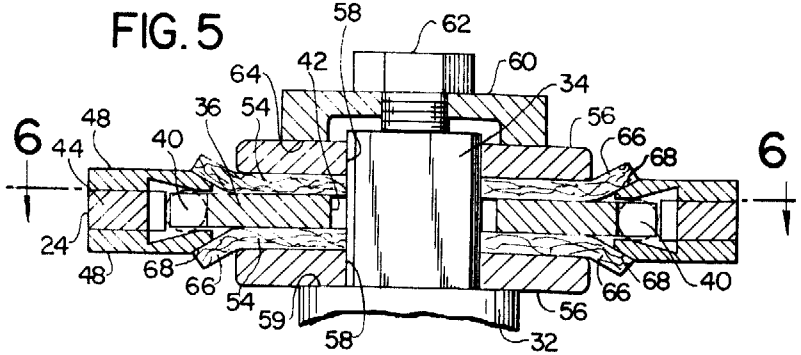
FIG. 5 is a somewhat further enlarged fragmentary sectional view taken along the line 5—5 of FIG. 2.

Referring now to FIGS. 4–6, the clutch 24 is a one-way engaging or uni-directional ball clutch and comprises an inner part of clutch dial 36 which has a plurality of circumaxially spaced and radially outwardly opening ball receiving recesses 38, 38, each of which contains a ball 40. A generally cylindrical central aperture 42 in the dial receives an associated spindle end portion 34 therethrough, as best shown in FIG. 6, to permit angular movement of the spindle relative to the clutch. The dial is circumaxially surrounded by an outer part or locking ring 44 which has a plurality of radially inwardly opening ball receiving recesses or notches 46, 46 therein, the number of notches in the locking ring being substantially greater than the number of recesses in the dial. The dial 36, the balls 40, 40 and the locking ring 44 are retained in assembled relation between a pair of retaining rings 48, 48 riveted in assembly with the locking ring. The recesses 38, 38 and the notches 46, 46 are constructed and arranged to cooperate with the balls 40, 40 to permit free rotation of the clutch dial 36 is only one direction relative to the locking ring 44. Hence, the clutch is uni-directional or uni-rotational.

In accordance with the presently preferred embodiment of the invention, the locking ring 44 has 24 equally spaced ball receiving notches, whereas the dial 36 has three pairs of diametrically opposed ball receiving recesses. The relative spacing of the recesses is such that each time the dial is rotated in a clockwise direction from a locking position through an angle of five degrees relative to the locking ring 44, a pair of diametrically opposed balls 40, 40 are brought into alignment with an associated pair of diametrically opposed ball receiving notches 46, 46. As oriented in the drawings, the dial 36 is free to rotate in a clockwise direction relative to the locking ring 44, but locks in coupled engagement with the locking ring when rotated in a counterclockwise direction relative to the locking ring and through an angle not greater than five degrees from any previous dial position. A radially outwardly opening latch recess 50 is provided in the peripheral edge of the clutch 24 for a purpose hereinafter evident. It should be noted that the side walls of the recess diverge outwardly or toward the open end thereof to define cam surfaces 52, 52.

A pair of annular clutch linings or friction pads 54, 54 are respectively disposed above and below the clutch dial 36 in face-to-face relation therewith. The pads are made from asbestos cloth or like friction material and are retained in frictional engagement with the clutch dial 36 by a pair of bearing plates 56, 56. Each bearing plate has a square central aperture 58 and is received on the spindle upper end portion 34 in non-rotatable engagement therewith. The lower bearing plate 56 abuts an upwardly facing spindle shoulder 59 as best shown in FIG. 5. A cap 60 received on the upper end of the spindle 34 is retained by a fastener 62 which threadably engages the end portion 34. The cap is recessed for clearance with the upper end of the spindle and has a downwardly facing annular bearing surface 64 which engages the upper bearing plate. Frictional engagement between the friction pads 54, 54 and the clutch dial 36 may be adjusted by turning the threaded fastener 62 in one or an opposite direction relative to the spindle 32. It should also be noted that each friction pad 54 has an annular marginal portion 66 which is exposed outwardly beyond an associated bearing plate 56 and engages a chamfered surface 68 on an associated retaining ring 48. Thus, the pad marginal portions 66, 66 cooperate with the retaining ring surfaces 68, 68 to provide frictional connection between the dial 36 and locking ring 44 to yieldably resist relative rotation of the latter clutch parts.

The mounting bracket or frame 69 is preferably formed from sheet metal and has a generally vertically disposed rear mounting portion 70 provided with a plurality of mounting holes (not shown) for securing the device to a door or a door frame. A plurality of mounting tabs 72, 72 project forwardly from the mounting portion and receive fasteners which secure the closer 20 to the bracket 69. A generally horizontally disposed upper portion extends forwardly from the mounting portion 70 above the closer 20 and defines a horizontally disposed mounting surface 73 to support the latching mechanism 26 and the holding and releasing mechanism 28.

Considering now the latching mechanism 26, with particular reference to FIG. 2, this mechanism includes an elongated latching lever 74 and a generally L-shaped holding lever 76. The holding lever is pivotally secured near one end of the mounting surface 73 and near the left end of the bracket by a pivot stud 78 staked to the bracket 69. A tab 80 bent upwardly on the other end of the holding lever 76 carries an armature plate 82 hereinafter further described. The latching lever 74 is pivotally mounted on the frame rearwardly and to the right of the clutch 24 by a pivot stud 84 which passes through the end of the lever and is staked to the frame. The latching lever 74 extends generally tangentially of the clutch 24 and is connected to the holding lever by another pivot stud 86 which passes through a slot in the left end of the lever and is staked to the holding lever 76 intermediate its ends. The left end of the latching lever is slightly offset and spaced above the holding lever, the spacing therebetween being maintained by a spacing washer received on the pivot stud 86. A relatively light torsion spring 88 surrounds the washer and has one free end thereof in engagement with the tab 80 and its other free end in engagement with a spring retaining stump 90 staked to the frame. A resilient stop cushion 92 surrounds the base of the stump to provide a buffer for the holding lever. The latching lever 74 carries a latch pin 94 which is alignable with the latching recess 50 and movable with the lever 74 into and out of latching engagement with the clutch 24. In FIG. 2, the latching position of the latching lever 74 is shown in full lines and the releasing position of the lever is shown by broken lines.

The holding mechanism 28 generally comprises an electromagnet 96 which in an electrically energized condition cooperates in holding engagement with the armature plate 82. The electromagnet is preferably adapted for direct current operation and for this reason a rectifier 98 is also mounted on the frame. The rectifier and electromagnet are supported on a mounting tab bent upwardly from the bracket 69. The armature plate 82 preferably comprises a circular disc of magnetic material which has a threaded shank projecting centrally therefrom and through an aperture in the mounting tab 80 to receive a retaining nut. A compression spring 100 surrounds the shank between the tab and the plate to facilitate adjustment of the armature plate 82 relative to the electromagnet 96. The spring mounted arrangement of the armature plate also facilitates self-alignment between the armature plate and the electromagnet to assure efficient operation of the device.

When the device 10 is installed, the various parts thereof are preferably initially positioned as shown in full lines in FIG. 2, the door being in its closed position. The electromagnet 96 is normally energized and may be electrically connected to a suitable sensing device responsive to a predetermined ambient temperature or smoke condition. Initial adjustment of the device 10 is made by simply opening the door to a desired hold-open position while the electromagnet 96 is energized to retain the latching lever 74 in its latched position. As previously noted, the clutch 24 is arranged to permit free rotation of the dial 36 in a clockwise direction relative to the locking ring 44. The dial 36 is frictionally coupled to the spindle 32 as previously described whereas the locking ring 44 is restrained against rotation by engagement of the latch pin 94 and the latch recess 50. Thus, as the door is moved toward an open position, as shown in FIG. 1, the clutch dial 36 rotates in a clockwise direction with the spindle 32 and relative to the locking ring 44. The marginal portions 66, 66 which engage the chamfered surfaces 68, 68 on the retaining rings offer negligible frictional resistance to clockwise rotation of the spindle and clutch dial.

When the door 12 is released in a fully or partially open position, the action of the closer 20 tends to produce some slight retrograde movement of the door toward its closed position. However, as will be evident from the previous description of the clutch 24, the clutch dial 36 will lock in position relative to the locking ring 44 as the dial moves in a counterclockwise direction through an angle of not more than five degrees relative to the locking ring. In accordance with the presently preferred arrangement for installation, two degrees of clutch dial movement is approximately equal to one degree of door movement. Hence, the retrograde movement of the door after release and toward its closed position will not normally be greater than approximately two and one-half degrees. The frictional coupling between the spindle 32 and the dial 36 is adjusted so that torque required to move the spindle relative to the dial when the clutch is in its locked position is greater than the torque applied to the spindle by the door closer 20. Accordingly, the door will be held in its adjusted open position as long as the electromagnet 96 remains in an energized state.

When the electromagnet is de-energized, as by operation of an ambient temperature or smoke sensing device in circuit therewith, the armature plate 82 and holding lever 76 cease to hold the latching lever 74 in its latching position. Thereafter, the latch pin 94 is retained in the latch recess 50 only by the biasing force exerted on the lever 74 by the relatively light torsion spring 88. The torque exerted upon the spindle 32 by the door closer 20 is sufficient to cause the latch pin 94 to be cammed out of the recess 50 by engagement with an associated inclined cam surface 52. When the clutch 24 has rotated to a position wherein the latch recess 50 is out of alignment with the latch pin 94, the latter pin is retained in engagement with the peripheral surface of the clutch by the biasing force of the spring 88. The latching lever 74 is then in its released or broken line position as it appears in FIG. 2. It will be noted that when the latter lever is in its released position, the armature plate 82 is displaced a substantial distance from the electromagnet 96 and is beyond the influence thereof.

Referring now to FIG. 2 and assuming that the arm 16 moves through an angle of approximately 45° to its broken line position indicated at **16*a* when the door is moved to its initial position of adjustment, it will be noted that the arm 16 has been displaced approximately 45° relative to the latch recess 50. Thereafter, when the holding mechanism releases and the door closes, the arm 16 rotates in a counterclockwise direction to return to its normal or full line position in FIG. 2 and the latch recess 50 is displaced in a counterclockwise direction to the position indicated by broken lines at 50*a*. The next time the door is opened, the entire clutch 24 rotates in a clockwise direction with the spindle 32.**

The latch pin 94 which is biased into engagement with the peripheral surface of the clutch 24 exerts a drag on the latter surface which tends to prevent the locking ring 44 from rotating in a clockwise direction with the spindle 32 and clutch dial 36. However, the frictional force exerted on the chamfered surfaces 68, 68 by the friction pad marginal portions 66, 66 is sufficient to resist the aforementioned drag. It will now be evident that the marginal portions 66, 66 function to retain the clutch in a predetermined position of adjustment. When the latch recess 50 is aligned with the latch pin 94, the pin is biased into the recess by the spring 88. If the electromagnet 96 is energized, the armature plate 82 will move into holding engagement therewith to maintain the door in hold-open position. Thus, once a particular hold-open position has been established, the door may be returned to that position of adjustment each time it is opened. A new position of adjustment may be established by further opening the door to a new position of adjustment beyond the previously established position.

The door may be adjusted from a fully open hold-back position or from any partially open hold-back position to a position of lesser opening by applying force to the door in the closing direction sufficient to overcome the frictional force which couples the clutch dial 36 to the spindle 32. Thus, the door 12 may be adjusted to an infinite number of hold-open positions by first moving it to a fully open position and then applying sufficient force in a closing direction to move it to any desired hold-open position.

Figure 7:
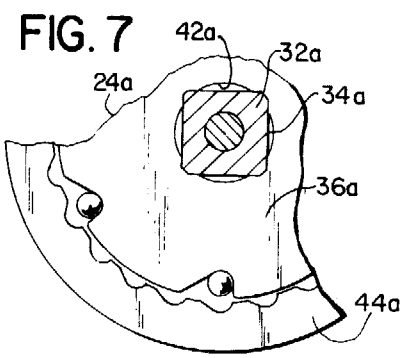
FIG. 7 is generally similar to FIG. 6 but shows another embodiment of the invention.

It is sometimes required that a door be maintained in either a fully open or fully closed position, as for example, a corridor door or the like. In such instance, it is undesirable that the door be adjustable from one hold-open position to another hold-open position of lesser opening. A further embodiment of the invention is provided to meet the requirements of this situation. This further embodiment differs from the one previously described only in the manner in which the clutch is retained on the door closer spindle. Such a further embodiment is illustrated in FIG. 7 wherein a fragmentary portion of a clutch is shown and designated generally at 24*a*. The clutch 24*a* is provided with a non-circular aperture in its clutch disc 36*a* for receiving an associated spindle end portion 34*a* in non-rotatable engagement therein, substantially as shown. The clutch 24*a* is mounted on a spindle end portion such as indicated at 34*a* in the manner previously described; however, in this instance, the friction pads function only to overcome the drag exerted upon the locking and retaining ring assembly by the latch pin 94 in the manner aforedescribed and to prevent loss of clutch adjustment due to shock or vibration resulting from door movement. When the device of the present invention is provided with a clutch such as 24*a* the hold-open position of the door may be adjusted by simply opening the door while the latching mechanism is held in its latched position. Thereafter, the device may be further adjusted to other wider hold-open positions by further opening the door. However, when the door attains its fully open position, no further adjustment may be attained by door movement. Thereafter, each time the door is moved to its fully open position with the holding mechanism in its energized condition the door will be held in its fully open position. If a lesser hold-open position is desired after the device has been adjusted to its full hold-open position, the clutch must be removed from and repositioned on the spindle end portion 34*a* to permit further adjustment. It should be noted that it is always possible to close the door even when the device is in a hold-open position and held in the latter position by the holding mechanism. Since the clutch is connected in non-rotatable engagement with the spindle 32*a* and the locking ring 44*a* is in locked engagement with the clutch dial 36*a* when the door is moved toward its closed position, it will be evident that if a sufficient closing force is applied to the door, the latching pin carried by the latch lever will be cammed out of the latch recess in the clutch by an associated cam surface of the recess. Thus, one of the cam surfaces of the latch recess cooperates with the latch pin to override the latching and holding mechanisms. Thereafter, the door will move to its closed position under the normal action of the closer 20.

Figure 10:
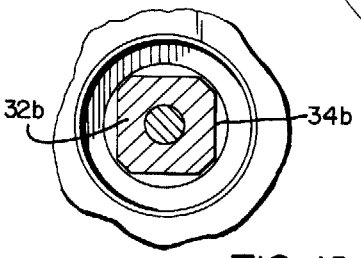
FIG. 10 is a fragmentary sectional view taken along the line 10—10 of FIG. 9.
Figure 8:
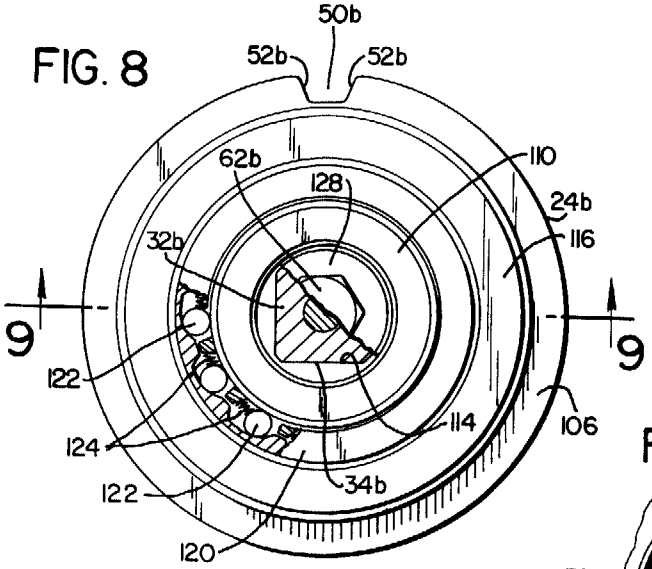
FIG. 8 is a fragmentary plan view similar to FIG. 4 and shows another embodiment of the invention.
Figure 9:
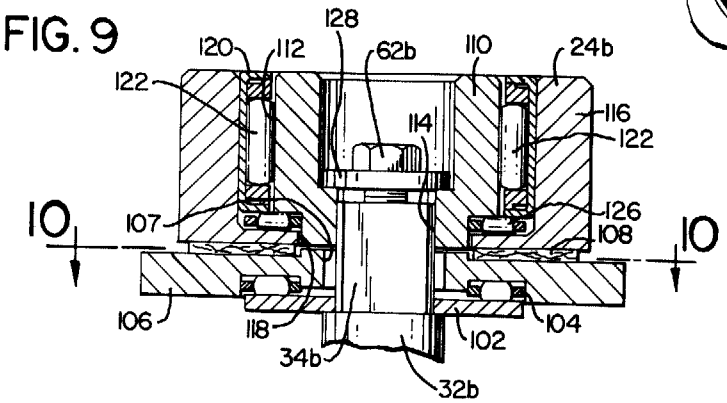
FIG. 9 is a fragmentary sectional view taken along the line 9—9 of FIG. 8.

Referring now to FIGS. 8–10, another electromagnetic door holder-closer is illustrated which embodies the invention and includes an overrunning roller clutch designated 24*b*. The illustrated embodiment differs from the previous embodiment 10 only in the construction and arrangement of the clutch mechanism 24*b*, therefore, only the spindle of the closer is shown, the latter spindle being designated generally by the reference numeral 32*b*. The clutch 24*b* transmits torque load in one direction but overruns freely in the opposite direction and comprises a circular bearing plate 102, preferably centrally apertured for non-rotatable connection to the spindle end portion 34*b*. An annular thrust bearing 104 received on the spindle end portion 34*b* in rolling engagement with the bearing plate 102 supports an annular holding ring 106 which has a circular central aperture 107 to permit rotation of the holding ring relative to the spindle end portion 34*b*. As in the previously described embodiment, the holding ring or clutch part 106 has a latch recess 50*b* partially defined by cam surfaces 52*b*, 52*b* for cooperation with the latching mechanism (not shown) in a manner previously described. An annular friction pad 108 made from suitable clutch lining material is positioned in face-to-face engagement with the upper face of the holding ring 106 and coaxially surrounds the spindle 34*b*.

The clutch 24*b* further includes a generally cylindrical spindle shaft extension 110 which has an outwardly facing cylindrical bearing surface 112 and a non-circular central aperture 114 for non-rotatable connection with the spindle end portion 34*b*. A cylindrical clutch housing 116 retained on the spindle end portion by the shaft extension 110 has a cylindrical aperture 118 which receives the lower end portion of the shaft extension 110 therethrough. A unitary roller clutch unit 120 received in press fit engagement within a cylindrical recess in the clutch housing 116, as best shown in FIG. 8, comprises an overrunning roller clutch which includes a plurality of drive units or rollers 122, 122 arranged to wedge between the bearing surface 112 and inclined surfaces associated with its outer shell to transmit torque load in only one direction, as is well known in the clutch art. The clutch 120 has a plurality of springs 124, 124 which aid in positioning the rollers for instant clutch engagement or lockup. Preferably, and as shown, the clutch 120 comprises a drawn cup overrunning roller clutch of a type manufactured by The Torrington Company, Torrington, Conn. The clutch housing 116 is further supported for rotation with the holding ring 106 and relative to the spindle 32*b* and the spindle extension 110 by another thrust bearing 126 which surrounds the lower end portion of the spindle extension, as best shown in FIG. 9. The clutch 24*b* is retained in assembly with the spindle end portion 34*b* by a threaded fastener 62*b* and a washer 128. The fastener 62*b* is adjusted to vary frictional engagement between the friction pad 108 and the holding ring 106 and clutch housing 116.

When the device is installed on a door, such as the door 12 in FIG. 1, the electrically operated holding mechanism is energized, and the door is opened, the entire clutch assembly 24*b* turns as a unit in a clockwise direction with the spindle 32*b* until the latch pin associated with the latch mechanism enters the latch recess 50*b*. Thereafter, due to the overrunning feature of the roller clutch, further movement of the door in the opening direction causes the spindle extension 110 to rotate with the spindle 32*b* and in a clockwise direction relative to the clutch unit 120, the clutch housing 122, the friction pad 108 and the holding ring 106. The fastener 62*b* is adjusted to provide sufficient frictional coupling between the clutch housing 116 and the holding ring 106, through the friction pad 108 to overcome reactive torque of the door closer exerted in a counterclockwise direction by the closer spindle 32*b* acting upon the clutch housing 116 through the spindle extension 110 and the clutch unit 120. Thus, the door will be held open in any position to which it is opened while the electromagnetic associated with the latching mechanism remains in an energized condition to retain the latching mechanism in its latching position. As in the previously described embodiment shown in FIGS. 1–6, the door may be adjusted from any hold-open position to a lesser hold-open position by applying force to the door in the closing direction sufficient to overcome the frictional force which couples the clutch housing 116 to the holding ring 106 while the holding ring is retained in a fixed position by the latching mechanism. Thus, the door may be held in a fully open position or may be adjusted to any partially open condition desired by simply manipulating the door.

Figure 11:
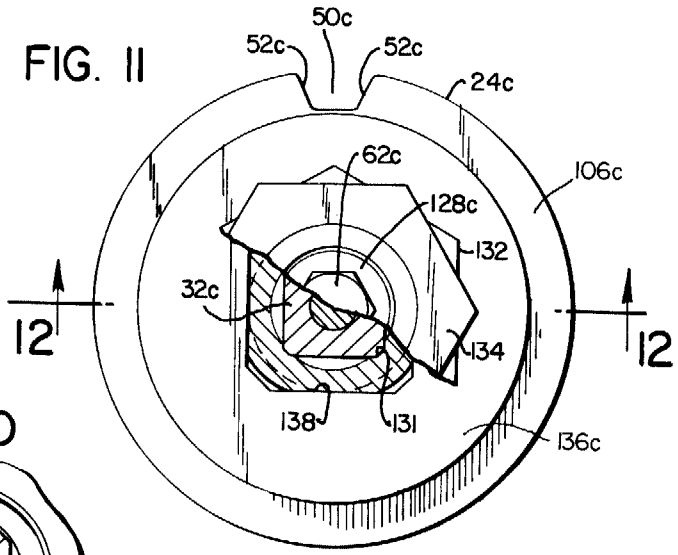
FIG. 11 is a fragmentary plan view similar to FIG. 4 and illustrates still another embodiment of the invention.
Figure 12:
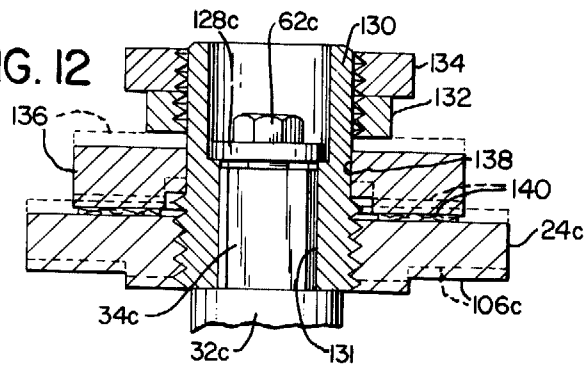
FIG. 12 is a sectional view taken along the line 12—12 of FIG. 11.

In FIGS. 11 and 12 there is shown still another embodiment of the invention particularly adapted for adjustment to hold a door in a single preselected hold-open position. Since the illustrated device differs from the device shown in FIGS. 1–6 only in the construction and arrangement of its clutch assembly 24*c*, only the closer spindle is shown and designated 32*c*. The clutch assembly 24*c* comprises a spindle stud 130 which has a non-circular central aperture 131 for non-rotatable connection with the spindle end portion 34*c*. It is retained in assembly with the spindle end portion by a fastener 62*c* and a washer 128*c*, as best shown in FIG. 12. The lower end portion of the spindle stud 130 is generally cylindrical and has a male thread thereon. The upper end portion of the stud 130 is threaded to receive an adjustment nut 132 and a lock nut 134 and has flats machined on its opposite sides to present a substantially non-circular cross section, as best shown in FIG. 11. A holding ring 106*c* is threaded onto the lower end portion of the spindle stud 130 and has a latch recess 50*c* formed therein and partially defined by cam surfaces 52*c*, 52*c*. The clutch 24*c* further includes a locking ring 136 which has a non-circular central aperture 138 for non-rotatable connection with the upper end portion of the spindle stud 130, as shown in FIG. 11, and is disposed on the spindle stud between the adjustment nut 132 and the holding ring 106*c*, as best shown in FIG. 12. An annular friction pad 140 made from suitable clutch lining material surrounds the spindle 32*c* and is positioned between opposing bearing surfaces on the holding ring 106*c* and the locking ring 136, as shown in FIG. 12. The clutch assembly 24*c* is handed, the hand of the clutch being determined by the hand of the threads on the holding ring and spindle stud, however, it may be made for doors of either hand.

In operation, the holding ring 106*c* is normally maintained in a fixed position relative to the closer casing by the latch mechanism (not shown) and its associated electrically operated holding mechanism (not shown). When an associated door, such as the door 12 (FIG. 1) is opened, rotation of the spindle 32*c* and its associated spindle stud 130 relative to the holding ring 106*c*, which is threaded onto the stud, causes the holding ring to move upward toward the locking ring 136 as the latter ring rotates with the spindle 32*c* and relative to the holding ring 106*c*. The upward movement of the holding ring 106*c* causes the locking ring 136 to move into abutting relation with the adjustment nut 132 thereabove. Thereafter, further rotation of the spindle stud 130 and the locking ring 136 causes a jamming relationship between the locking ring 136, the holding ring 106*c*, and the friction pad 106 positioned therebetween. If sufficient force is applied in opening the door to its hold-open position, the resulting frictional or jamming relationship between the rings will be sufficient to overcome the reactive force exerted in a closing direction by the door closer so that the door will be maintained in an open position. The door will remain in its predetermined hold-open position until either sufficient force is applied to the door in a closing direction to release the frictional coupling between the locking and holding rings or the latch mechanism is released, as by de-energizing the electromagnetic holding mechanism. After the door has been released from its predetermined hold-open position, it will close under the reactive force exerted by the closer mechanism. The predetermined hold-open position may be varied by loosening the lock nut 134 and moving the adjustment nut 132 toward or away from the locking ring 136, as required, to attain a desired hold-open position.

As in all of the previously described embodiments, one of the cam surfaces 52*c*, 52*c* is adapted to cooperate with the latch pin received in the recess 50*c* to cam it out of the recess in response to manual closing force applied to the door. Thus, means are provided to override the latching and holding mechanisms so that an associated door may be manually closed at all times.

As previously noted, the aforedescribed devices are usually connected in circuit with some type of sensing device for detecting an emergency situation, however, it should be understood that the devices of the present invention may be arranged to operate in response to any current interruption device as, for example, a simple electrical switch, to facilitate remote or local operation.

We claim:

1. A holder-closer for a door member mounted for pivotal movement between open and closed positions relative to a frame member and comprising a casing for mounting in fixed position relative to one of the members, a spindle journalled in said casing for axial rotation in one and an opposite direction relative thereto and projecting therefrom, resilient means yieldably resisting rotation of said spindle in said one direction, dampening means contained in said casing for yieldably resisting rotation of said spindle in said opposite direction in response to reactive torque applied to said spindle by said resilient means to control the closing speed of the door, arm means connected to said spindle externally of said casing for connection to the other of the members to rotate said spindle in said one direction when the door is opened, a clutch, means for coupling one part of said clutch to said spindle externally of said casing for rotation with said spindle in said one and said opposite direction, latching means supported for movement relative to said casing between latching and releasing position and engaging another part of said clutch in said latching position to retain said other part against rotation relative to said casing, said one part being rotatable in said one direction with said spindle and arm means and relative to said other part when said latching means is in its latching position and the door is opened to a hold-open position, said other part cooperating with said one part to restrain said one part against rotation in said opposite direction in response to said reactive torque while said door is in its hold-open position and said latching means is in its latching position, and electrically operated holding means for releasably retaining said latching means in its latching position.

2. The combination as set forth in claim 1 wherein said coupling means comprises means for frictionally connecting said one part to said spindle.

3. The combination as set forth in claim 1 wherein said coupling means comprises means connecting said one part in non-rotatable engagement with said spindle.

4. The combination as set forth in claim 3 including means for moving said latching means from said latching position to said releasing position in response to manual force applied to the door to move the door toward its closed position when said latching means is held in its latching position by said holding means.

5. The combination as set forth in claim 4 wherein said means for moving said latching means comprises a cam surface on said clutch.

6. The combination as set forth in claim 1 wherein said coupling means comprises means for coupling said spindle to said one part to permit said spindle to rotate in said opposite direction relative to said clutch in response to manual force applied to said door to move the door toward another position when the latching means is in said latching position.

7. The combination as set forth in claim 1 wherein said latching means comprises a lever system and said holding means comprises an electromagnet and an armature carried by said lever system and cooperating with said electromagnet to releasably retain said lever system in said latching position.

8. A holder-closer for a door as set forth in claim 1 wherein said clutch includes coaxially arranged inner and outer parts and said one part comprises said inner part and said other part comprises said outer part.

9. The combination as set forth in claim 8 including means for biasing said latching means into said latching position.

10. The combination as set forth in claim 8 including means for connecting said outer part to said inner part to yieldably resist rotation relative thereto in said one direction when said latching means is in said releasing position.

11. The combination as set forth in claim 10 wherein said coupling means comprises said means for connecting said outer part to said inner part.

12. The combination as set forth in claim 11 wherein said coupling means comprises means for frictionally connecting said inner part to said spindle and means for frictionally connecting said inner part to said outer part.

13. The combination as set forth in claim 1 wherein said clutch comprises a uni-directional clutch which includes a plurality of drive elements for permitting said one part to rotate in said one direction with said spindle and relative to said other part and providing torque transmission connection between said one part and said other part in response to said reactive torque applied to said spindle by said resilient means.

14. The combination as set forth in claim 13 wherein said uni-directional clutch comprises an overrunning roller clutch and said drive elements comprise rollers.

15. The combination as set forth in claim 13 wherein said clutch includes means for frictionally coupling said one part to said other part.

16. The combination as set forth in claim 1 wherein said one part comprises a generally cylindrical spindle extension, said clutch includes a generally cylindrical clutch housing supported on said spindle for coaxial rotation relative to said spindle and said spindle extension and a unitary roller clutch disposed between said spindle extension and said spindle housing for permitting said spindle extension to rotate in said one direction with said spindle and relative to said spindle housing and for providing torque transmission connection between said spindle extension and said housing in response to said reactive torque, said other part is supported on said spindle for coaxial rotation relative thereto, and said clutch further includes means for coupling said other part to said clutch housing.

17. The combination as set forth in claim 16 wherein said means for coupling said other part is further characterized as means for frictionally coupling said other part to said clutch housing.

18. The combination as set forth in claim 1 wherein said clutch includes means for moving one of said clutch parts comprising said one and said other part of said clutch toward the other of said clutch parts and into jamming relation therewith in response to rotation of said spindle in said one direction when the door is opened to a predetermined hold-open position and said other part is retained against rotation relative to said casing by said latching means.

19. The combination as set forth in claim 18 wherein said means for moving said one of said clutch parts comprises means for moving said one of said clutch parts axially of said spindle and toward the other of said clutch parts and for simultaneously rotating said one of said clutch parts relative to said other of said clutch parts in response to rotation of said spindle in said one direction.

20. The combination as set forth in claim 19 wherein said means for moving said one part of said clutch parts comprises coengaging threads on said one of said clutch parts and on an associated other part of said clutch.

21. The combination as set forth in claim 1 wherein said coupling means comprises a spindle stud mounted on said spindle for rotation in said one and said opposite direction therewith, said one part comprises a locking ring coaxially received on said spindle for rotation therewith, said other part comprises a holding ring coaxially received on said spindle, and said clutch includes means for moving one of the rings axially of said spindle toward the other of said rings and into jamming relation therewith when said latching means is in its latching position and the door is opened to a predetermined hold-open position.

22. The combination as set forth in claim 21 wherein said means for moving said one ring comprises coengaging threads on said holding ring and said spindle stud.

23. The combination as set forth in claim 21 wherein said clutch includes adjusting means for varying said predetermined hold-open position.

24. The combination as set forth in claim 23 wherein said adjusting means comprises an adjustment nut threadably received on said spindle stud for axial adjustment toward and away from said locking ring.

25. The combination comprising a door closer for mounting between a door member and a frame member, and a hold-open attachment, said door closer having a casing for mounting on one of the members, a spindle rotatably supported in said casing and projecting therefrom, means for connecting said spindle to the other of said members to rotate in one direction in response to movement of said door toward its open position and to rotate in an opposite direction in response to movement of said door toward its closed position, and resilient means in said casing yieldably resisting rotation of said spindle in said one direction, said hold-open attachment having a frame for mounting on said one member in fixed relation to said casing, a uni-directional clutch having one part free to rotate in only one direction relative to another part thereof, means for coupling said one part to said spindle, latching means supported on said frame for movement relative thereto between latching and releasing positions, said latching means cooperating with said clutch in said latching position for releasably retaining said other part against movement relative to said frame to permit said spindle to rotate in said one direction with said one part and to resist rotation in said other direction in response to torque applied thereto by said resilient means, and electrically operated holding means for releasably retaining said latching means in said latching position.

26. The combination as set forth in claim 25 wherein said spindle has opposite end portions projecting from opposite sides of said casing, said arm being connected to one of said end portions, said clutch being coupled to the other of said end portions.

27. The combination as set forth in claim 25 wherein said coupling means comprises means for coupling said one part to said spindle to permit said shaft to rotate in said other direction relative to said one part in response to manual force applied to said door to move it towards its closed position when said latching means is held in its latching position by said holding means.

28. The combination as set forth in claim 27 wherein said coupling means comprises means for frictionally connecting said one part to said shaft.

29. The combination as set forth in claim 25 including means for connecting said other part to said one part to yieldably resist rotation relative thereto.

30. The combination as set forth in claim 29 wherein said coupling means comprises said means connecting said other part to said one part.

31. The combination as set forth in claim 30 wherein said coupling means comprises means frictionally connecting said one part to said spindle and means frictionally connecting said one part to said other part.

32. The combination as set forth in claim 25 wherein said coupling means comprises means for non-rotatably connecting said one part to said spindle.

33. The combination as set forth in claim 32 including means for moving said latching means from said latching to said releasing position in response to manual force applied to the door to move it toward its closed position when said latching means is held in its latching position by said holding means.

34. The combination as set forth in claim 33 wherein said means for moving said latching means from said latching position comprises a cam surface on said other part.

35. The combination as set forth in claim 25 wherein said latching means comprises a lever and said holding means comprises an electromagnet.

36. A hold-open attachment for a door closure for connection between a door and an associated door frame and having a casing, a spindle rotatably supported in said casing and projecting therefrom and rotatable in one direction in response to movement of the door toward an open position and in an opposite direction in response to movement of the door toward a closed position, and resilient means in said casing for yieldably resisting rotation of the spindle in said one direction, said attachment comprising an attachment frame for mounting in fixed position relative to said casing, a clutch, means for coupling said clutch to said spindle externally of said casing for rotation therewith, latching means mounted on said attachment frame and movable relative thereto between latching and releasing positions, said latching means cooperating with said clutch in said latching position to retain a part of said clutch in fixed position relative to said frame to permit said spindle to rotate in said one direction in response to movement of the door to a hold-open position and to resist rotation of said spindle in said other direction in response to torque applied to said spindle by said resilient means to retain the door in hold-open position, and electrically operated holding means for releasably retaining said latching means in said latching position.

37. A hold-open attachment as set forth in claim 36 wherein said clutch comprises a uni-directional ball clutch having coaxial inner and outer parts and a plurality of balls disposed therebetween and cooperable therewith to permit substantial relative rotation between said parts in only said one direction.

38. A hold-open attachment as set forth in claim 37 wherein said spindle is connected to said inner part by said coupling means and said latching means is cooperable with said outer part.

39. A hold-open attachment as set forth in claim 36 wherein said latching means comprises a latching lever pivotally mounted on said attachment frame and a latch pin carried by said latching lever and said clutch part has a latch recess for receiving said latch pin in said latching position.

40. A hold-open attachment as set forth in claim 39 wherein said latching means includes a holding lever pivotally connected to said attachment frame and to said latching lever, said holding means cooperating with said holding lever.

41. A hold-open attachment as set forth in claim 36 wherein said electrically operated holding means includes an armature associated with said latching means and an electromagnet active in an energized condition to hold said armature when said latching means is in said latching position.

42. A hold-open attachment as set forth in claim 36 including means for biasing said latching means towards said clutch.

43. A hold-open attachment as set forth in claim 36 wherein said coupling means comprises means frictionally connecting said clutch to said spindle.

44. A hold-open attachment as set forth in claim 36 wherein said coupling means comprises means connecting said clutch in non-rotatable engagement with said shaft.

45. A hold-open attachment as set forth in claim 36 including means for overriding said latching means and said holding means and for moving said latching means to said releasing position against the action of said holding means in response to manual force applied to the door to move it towards its closed position.

46. A hold open attachment as set forth in claim 36 wherein said clutch has an inner part and an outer part, said coupling means connects said inner part to said spindle, said latching means cooperates with and retains said outer part in said latching position, and said attachment includes means for connecting said outer part to said inner part to yieldably resist rotation relative thereto.

47. A hold-open attachment as set forth in claim 37 wherein said coupling means comprises said means for connecting said outer part to said inner part to yieldably resist rotation.

48. A hold-open attachment as set forth in claim 47 wherein said coupling means comprises means for frictionally connecting said spindle to said inner part and said means for frictionally connecting said inner part to said outer part.

49. A hold-open attachment as set forth in claim 37 wherein said inner part has a plurality of radially outwardly opening ball receiving recesses and said outer part has a plurality of radially inwardly opening ball receiving recesses, the number of ball receiving recesses in one of said parts being equal in number to the number of balls, the number of ball receiving recesses in the other of said parts being substantially greater than the number of balls.

50. A hold-open attachment as set forth in claim 49 wherein said one part comprises said inner part and said other part comprises said outer part.

* * * * *

UNITED STATES PATENT AND TRADEMARK OFFICE

CERTIFICATE OF CORRECTION

PATENT NO. : 3,935,614

DATED : February 3, 1976

INVENTOR(S) : Robert John Pannone, Walter Edward Surko, Jr.

It is certified that error appears in the above-identified patent and that said Letters Patent are hereby corrected as shown below:

Column 2, line 34, "unidirectional" should be --uni-directional--.

Column 2, line 37, "liner" should be --lever--.

Column 7, lines 36 and 37, "latching pin" should be --latch pin-- and "latch lever" should be --latching lever--.

Signed and Sealed this

*twenty-second* Day of *June 1976*

[SEAL]

*Attest:*

RUTH C. MASON
*Attesting Officer*

C. MARSHALL DANN
*Commissioner of Patents and Trademarks*